US007243891B2

(12) United States Patent
Wu et al.

(10) Patent No.: US 7,243,891 B2
(45) Date of Patent: Jul. 17, 2007

(54) MOUNTING BRACKET, AND METHOD THEREFOR

(75) Inventors: Wen-Chang Wu, Chang Hua Hsien (TW); Jeffrey F. Jacumin, Connelly Springs, NC (US); Brian J. Severson, Statesville, NC (US)

(73) Assignee: Lowe's Companies, Inc., Wilkesboro, NC (US)

( * ) Notice: Subject to any disclaimer, the term of this patent is extended or adjusted under 35 U.S.C. 154(b) by 129 days.

(21) Appl. No.: 10/411,878

(22) Filed: Apr. 10, 2003

(65) Prior Publication Data

US 2004/0200944 A1 Oct. 14, 2004

Related U.S. Application Data

(63) Continuation-in-part of application No. 10/192,797, filed on Jul. 11, 2002, now Pat. No. 6,964,505.

(51) Int. Cl.
*B42F 13/00* (2006.01)

(52) U.S. Cl. ..... 248/342; 248/300; 362/406

(58) Field of Classification Search ..... 248/342, 248/343, 344, 317, 300, 301, 304, 322; 362/147, 362/148, 405, 406, 404
See application file for complete search history.

(56) References Cited

U.S. PATENT DOCUMENTS

| | | | | |
|---|---|---|---|---|
| 1,453,233 | A | 4/1923 | Ball, Jr. | |
| 1,901,235 | A * | 3/1933 | Glowacki | 248/343 |
| 2,448,001 | A | 8/1948 | Maurette | |
| 2,507,308 | A * | 5/1950 | Kruger | 248/343 |
| 2,509,895 | A * | 5/1950 | Wakefield | 248/343 |
| 2,711,876 | A * | 6/1955 | Goebel | 248/343 |
| 2,967,040 | A | 1/1961 | Picha | |
| 2,990,153 | A | 6/1961 | Wolar | |
| 3,041,035 | A * | 6/1962 | Pascucci | 248/342 |
| 3,302,918 | A | 2/1967 | Cohen | |
| 3,378,221 | A | 4/1968 | Wolar et al. | |
| 3,620,376 | A * | 11/1971 | Gingher | 211/123 |
| 3,736,417 | A * | 5/1973 | Williams | 362/430 |
| 4,041,657 | A * | 8/1977 | Schuplin | 52/39 |
| 4,064,427 | A | 12/1977 | Hansen et al. | |

(Continued)

FOREIGN PATENT DOCUMENTS

JP 05 094710 A 4/1993

(Continued)

*Primary Examiner*—Kimberly T. Wood
(74) *Attorney, Agent, or Firm*—Alston & Bird LLP

(57) ABSTRACT

A bracket for attachment to a support for mounting a fixture, and method for installing the same are provided. The bracket includes a base having first and second sides. The bracket also includes first and second flanges extending from the first side of the base, the first and second flanges defining an elongate aperture therebetween. The elongate aperture further extends from the first side of the base towards the second side of the base. The elongate aperture is adapted to movably receive one end of the fixture so that the fixture may be mounted to, and demounted from, the bracket by sliding the end of the fixture at least partially along the length of the elongate aperture and wherein the first and second flanges are structured to contact the support to provide lateral support to the base and the fixture.

22 Claims, 6 Drawing Sheets

U.S. PATENT DOCUMENTS 4,303,968 A * 12/1981 Goralnik ..... 362/147
4,695,114 A * 9/1987 Stanton et al. ..... 439/573
4,700,917 A * 10/1987 Dillman ..... 248/227.4
4,788,383 A 11/1988 Caison
4,864,941 A * 9/1989 Goulter ..... 108/132
4,934,644 A * 6/1990 Nagy et al. ..... 248/230.8
5,484,076 A * 1/1996 Petrushka ..... 220/3.9
5,546,724 A * 8/1996 Reinklou ..... 52/698
6,036,154 A 3/2000 Pearce
6,746,138 B1 * 6/2004 Neeld et al. ..... 362/414

FOREIGN PATENT DOCUMENTS

JP 08 298014 A 11/1996
JP 11 283430 A 10/1999

* cited by examiner

MOUNTING BRACKET, AND METHOD THEREFOR

CROSS REFERENCE TO RELATED APPLICATION

This application is a continuation-in-part of copending U.S. patent application Ser. No. 10/192,797, filed Jul. 11, 2002, now U.S. Pat. No. 6,964,505 which is hereby incorporated herein in its entirety by reference.

BACKGROUND OF THE INVENTION

1) Field of the Invention

The present invention relates to overhead fixtures and, more particularly, to mounting brackets for overhead fixtures.

2) Description of Related Art

There are currently available a wide variety of overhead or ceiling-mounted light fixtures, such as chandeliers, which extend from the ceiling of a room. When installing a ceiling-mounted light fixture, the light fixture must be attached to the ceiling support structure, i.e., joist(s), to insure that the light fixture is secure. In this regard, an opening typically is made in the ceiling, which can be formed of drywall, plaster or a similar material. An electrical junction box is typically mounted within the opening to one or more ceiling joist(s) using fasteners, such as nails or screws, so that the bottom edge of the electrical junction box is flush with the ceiling. Electrical wiring is then wired into the electrical junction box so that it can be connected to wires from the light fixture.

To mount a light fixture, a conventional mounting bracket is secured to the bottom edge of the electrical junction box using fasteners, such as screws or bolts. Conventional mounting brackets typically comprise a planar piece of metal that includes a threaded aperture for receiving a hollow threaded stem or nipple. Once the stem is threaded into the aperture in the bracket, a nut can be placed onto each end of the stem and tightened against the corresponding side of the bracket to insure that the stem is securely fastened to the bracket. The support member and light fixture are then raised toward the stem so that the wiring of the light fixture can be threaded through the stem. To secure the light fixture to the mounting bracket, the support member of the light fixture is attached to the end of the stem, such as by threading the support member onto the stem, while the installer supports the weight of the light fixture. The wiring of the light fixture is then connected to the wiring in the electrical junction box. A canopy is then secured to the support member using a decorative locking nut to cover the aperture and conceal the electrical junction box, wiring and mounting bracket.

When mounting a light fixture to a conventional mounting bracket, the installer must use two hands such that one hand is supporting the light fixture while the other hand is inserting the wiring of the light fixture through the stem and, thereafter, threading the support member of the light fixture onto the stem. Since the installer must use two hands, installing and uninstalling ceiling-mounted light fixtures using conventional mounting brackets can be a difficult, if not dangerous task, particularly if the installer is working from a stool or ladder. In addition, adjusting the height of an overhead light fixture installed using a conventional mounting bracket generally requires that the entire light fixture be disassembled.

Thus, there exists a need for an improved mounting bracket for an overhead light fixture. The improved mounting bracket should simplify the installation of overhead light fixtures and should provide a secure engagement with improved lateral support in comparison to conventional mounting brackets.

BRIEF SUMMARY OF THE INVENTION

The present invention provides a bracket for attachment to a support for mounting a fixture, and method for installing the same. According to one embodiment, the bracket includes a base having first and second sides. The bracket also includes first and second flanges extending from the first side of the base. The first and second flanges define an elongate aperture therebetween. The elongate aperture further extends from the first side of the base towards the second side of the base. The elongate aperture is adapted to movably receive one end of the fixture so that the fixture may be mounted to, and demounted from, the bracket by moving the end of the fixture at least partially along the length of the elongate aperture and wherein the first and second flanges are structured to contact the support to provide lateral support to the bracket and the fixture. In one embodiment, the base and the first and second flanges are integrally formed. In another embodiment, the base and the first and second flanges are formed of steel. In yet another embodiment, the first and second flanges extend from the base at least partially towards the second side of the base so as to define an acute angle between the base and each of the first and second flanges. In yet another embodiment, the bracket includes a third flange extending from the second side of the base. According to one embodiment, the third flange extends from the second side of the base at least partially towards the first side of the base so as to define an acute angle between the base and the third flange. The third flange is preferably structured to contact the support and provide lateral support to the bracket and fixture.

In another embodiment, the present invention provides a mounting system for attaching a fixture to a support. The mounting system includes a connector having first and second ends. The first end of the connector is structured for attachment to the fixture. In one embodiment, the connector comprises an elongate threaded portion extending at least partially between the first and second ends of the connector. The connector can include an expanded portion disposed at the second end of the connector and a fastener defining an aperture therethrough structured to threadingly engage the elongate threaded portion. The fastener is disposed adjacent to the expanded portion and is adjustable relative thereto along the length of the threaded portion.

The mounting system also includes a bracket comprising a base having first and second sides. The bracket also includes first and second flanges extending from the first side of the base. The first and second flanges define an elongate aperture therebetween. The elongate aperture further extends from the first side of the base towards the second side of the base. The elongate aperture is adapted to movably receive the second end of the connector so that the fixture may be mounted to, and demounted from, the bracket by moving the second end of the connector at least partially along the length of the elongate aperture and wherein the first and second flanges are structured to contact the support to provide lateral support to the bracket and the fixture. Other variations of the bracket are discussed above.

The present invention also provides a method of attaching a fixture to a support. According to one embodiment, the method includes attaching a bracket to a support, the bracket comprising a base having first and second sides and first and second flanges extending from the first side of the base, the first and second flanges defining an elongate aperture therebetween, the elongate aperture further extending from the first side of the base towards the second side of the base, and wherein the first and second flanges are structured to contact the support to provide lateral support to the bracket and the fixture. One end of a fixture is moved at least partially along the length of the elongate aperture so that the fixture is mounted to the bracket. The end of the fixture is then secured to the bracket. In one embodiment, the securing step includes threading a fastener along a threaded portion of a connector so that the fastener secures at least a portion of the bracket between the fastener and an expanded portion of the connector. In another embodiment, the method includes connecting the electrical wiring from the fixture to the electrical wiring at the support. In yet another embodiment, one end of the fixture is moved at least partially along the length of the elongate aperture so that the fixture is demounted from the bracket.

BRIEF DESCRIPTION OF THE SEVERAL VIEWS OF THE DRAWINGS

The foregoing and other advantages and features of the invention, and the manner in which the same are accomplished, will become more readily apparent upon consideration of the following detail description of the invention taken in conjunction with the accompanying drawings, which illustrate preferred and exemplary embodiments and which are not necessarily drawn to scale, wherein.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 12:
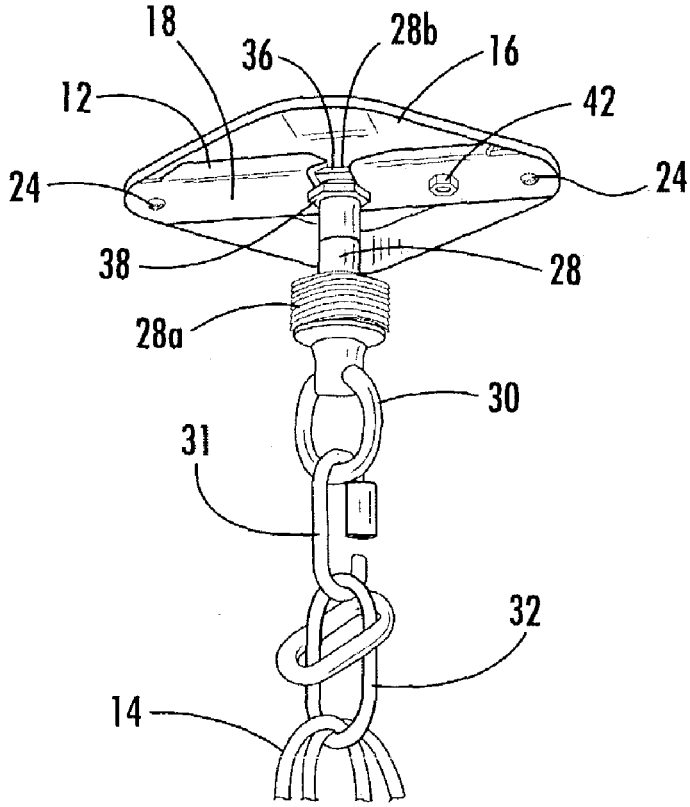
FIG. 12 is a perspective view illustrating the connector and mounting bracket of FIG. 9 securing a fixture to a junction box.

Referring to FIG. 12, there is illustrated a mounting system 10, according to one embodiment of the present invention. The mounting system 10 includes a bracket 12 for attaching overhead fixtures 14 to a support 16, which provides greater lateral support to the bracket and fixture and simplifies installation, removal, and height adjustment in comparison to conventional mounting brackets. The fixture 14 preferably includes an overhead light fixture, such as a chandelier or other light fixture that can be suspended using a hanging device, such as cordage, chains or elongate rods. However, fixture 14 is not limited to light fixtures, but can also include other ornamental, artistic or aesthetic items such as pictures, plants, baskets, etc.

Figure 1:
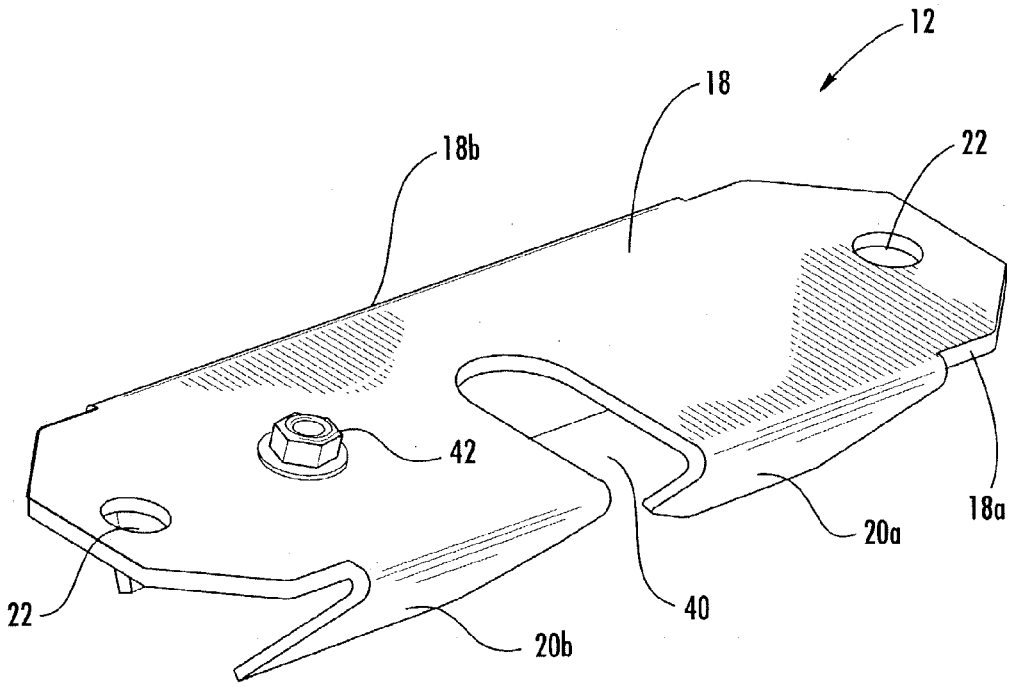
FIG. 1 is a perspective view illustrating a mounting bracket, according to one embodiment of the present invention.
Figure 2:
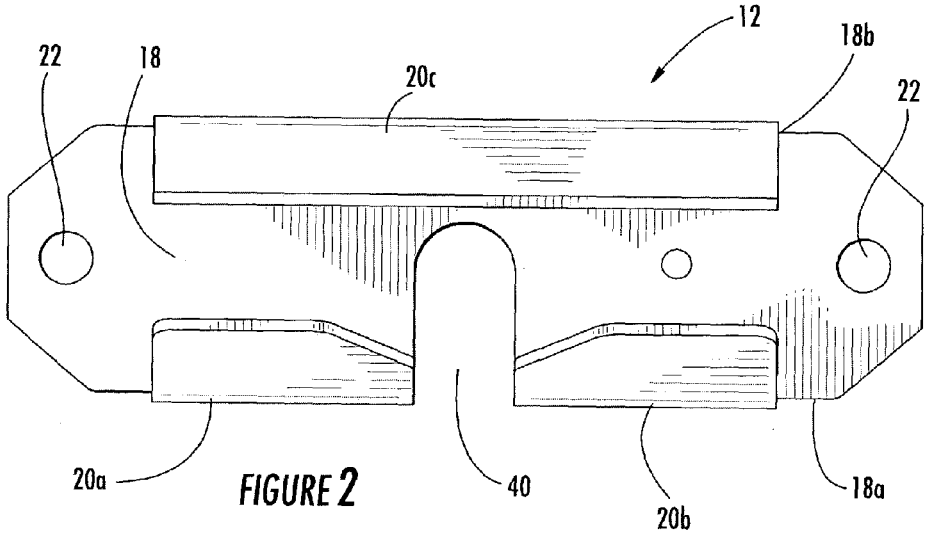
FIG. 2 is a plan view illustrating the mounting bracket of FIG. 1.
Figure 6:
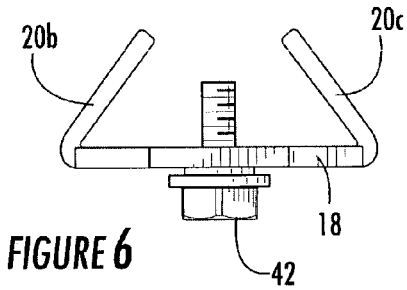
FIG. 6 is an elevation view illustrating the mounting bracket of FIG. 1.

Referring to FIGS. 1-5, the bracket 12 includes a base 18 having first and second sides 16*a*, 16*b*. The base 18 can be configured as necessary depending on the configuration of the support 16, but preferably comprises a planar web portion. According to the illustrated embodiment, the bracket 12 includes three flanges 20*a*, 20*b*, 20*c* extending from the base 18. The first and second flanges 20*a*, 20*b* extend from the first side 18*a* of the base 18 and the third flange 20*c* extends from the second side 18*b* of the base. According to one embodiment, as illustrated in FIGS. 2 and 6, the first and second flanges 20*a*, 20*b* extend from the first side 18*a* of the base 18 at least partially towards the second side 18*b* of the base and the third flange 20*c* extends from the second side 18*b* of the base at least partially toward the first side 18*a* of the base so that each flange forms an acute angle with the base. Advantageously, the acute angle of the flanges 20*a*, 20*b*, 20*c* prevents the fixture 14 from becoming inadvertently dislodged from the bracket 12. In other embodiments (not shown), the flanges 20*a*, 20*b*, 20*c* can be disposed perpendicular to the base 18 or at an obtuse angle.

Preferably, the flanges 20*a*, 20*b*, 20*c* are formed integrally with the base 18, but the flanges can be formed separately and then attached to the base using mechanical fasteners or welding (not shown). The bracket 12 can be formed of a variety of materials, including, but not limited to, steel or other metals or composite materials, provided the materials have sufficient strength and, if necessary for outdoor applications, corrosion resistance for the particular applications contemplated.

Figure 3:
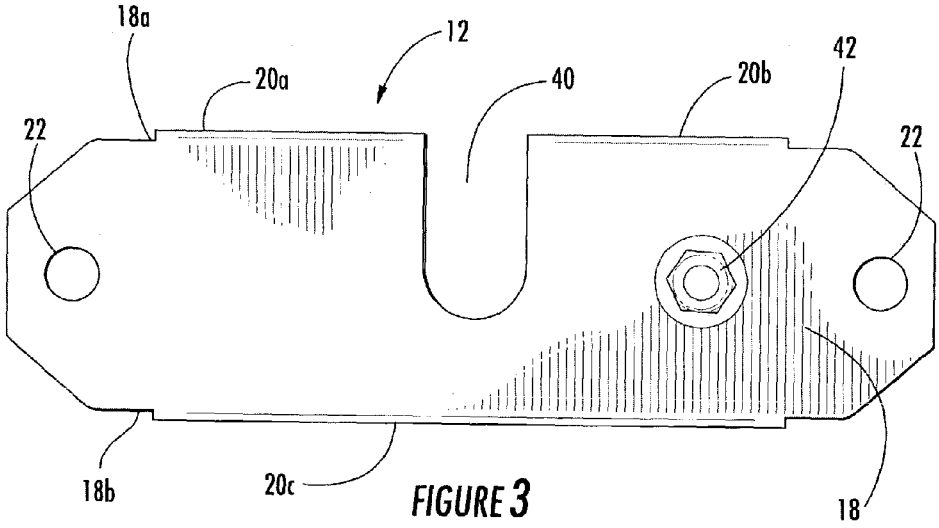
FIG. 3 is a plan view illustrating the mounting bracket of FIG. 1.
Figure 7:
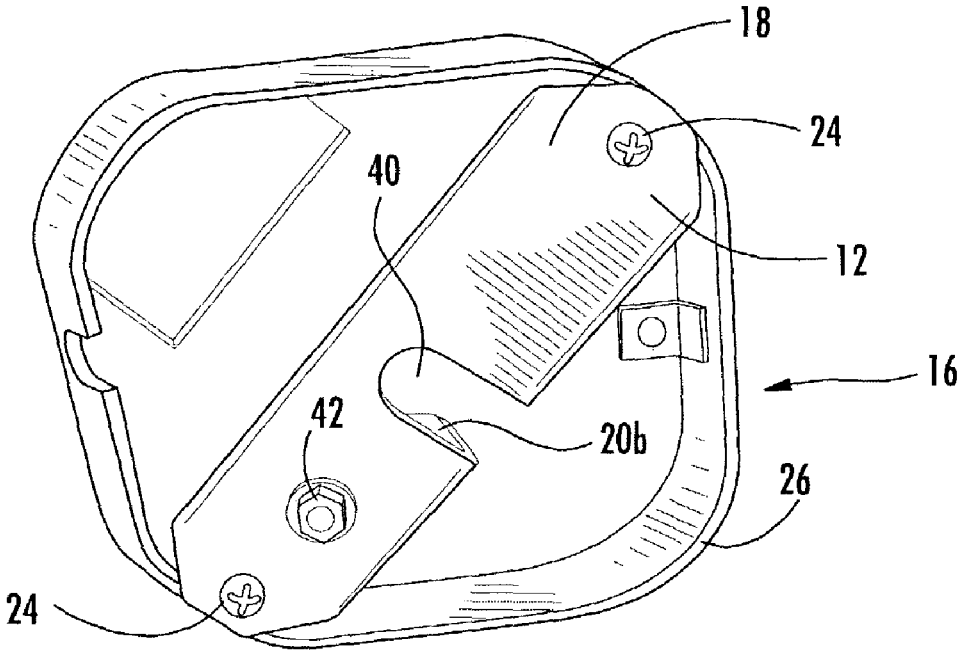
FIG. 7 is a perspective view illustrating the mounting bracket of FIG. 1 attached to a junction box, according to one embodiment of the present invention.

Referring to FIGS. 2 and 3, the base 18 of the bracket 12 defines a pair of apertures 22 adapted to receive corresponding fasteners 24. As illustrated in FIG. 7, the fasteners 24 can comprise screws, bolts or the like. The fasteners 24 are used to secure the bracket 12 to the support 16, which can include one or more joists or other framing members (not shown) or, as illustrated in FIG. 7, an electrical junction box 26. Referring to FIG. 7, the angled flanges 20*a*, 20*b*, 20*c* extend into the electrical junction box 26 when the bracket 12 is mounted to the box. Advantageously, since at least a portion of each of the angled flanges 20*a*, 20*b*, 20*c* is in contact with a side of the electrical junction box 10, the bracket 12 of the present invention has greater lateral support than a conventional planar mounting bracket. In addition, because the bracket 12 of the present invention has a greater load bearing surface area than a conventional planar mounting bracket, there is a reduction in the stress applied to the bracket 12 when supporting a fixture 14 so that the bracket of the present invention can support heavier fixtures. In other embodiments of the invention (not shown) where the flanges 20*a*, 20*b*, 20*c* are disposed perpendicular to the base 18 or at an obtuse angle to the base, the flanges 20*a*, 20*b*, 20*c* of the bracket 12 preferably will extend from the base 18 so that the flanges will at least partially contact the support to provide improved lateral support to the bracket 12 and fixture 14.

Figure 8:
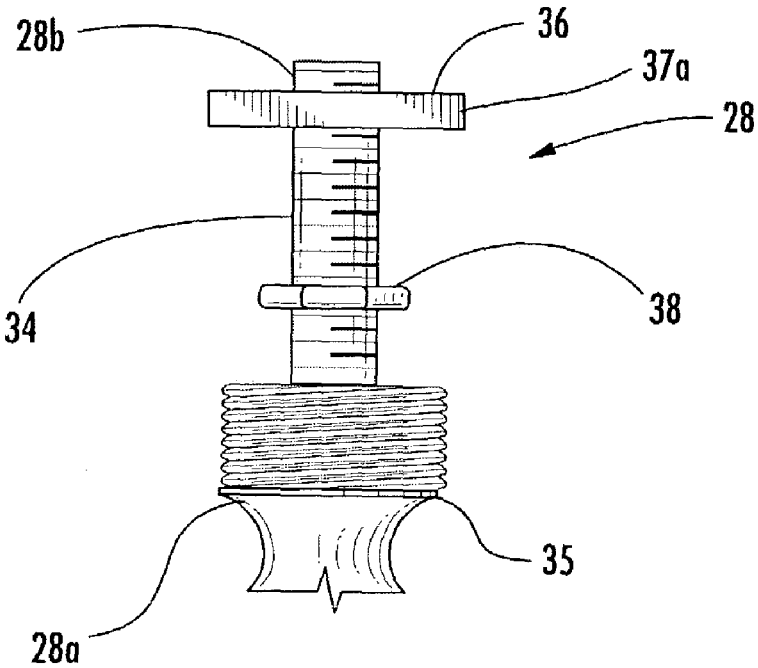
FIG. 8 is an elevation view illustrating a connector, according to one embodiment of the present invention.
Figure 11:
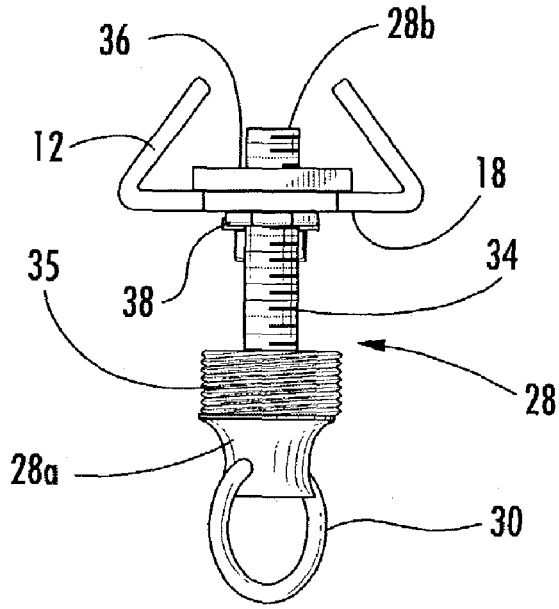
FIG. 11 is an elevation view illustrating the connector and mounting bracket of FIG. 10.

Referring to FIGS. 8 and 12, the mounting system 10 includes a connector 28 having first and second ends 28*a*, 28*b*. The first end 28*a* of the connector 28 is structured for attachment to the fixture 14. For example, certain overhead fixtures 14 are suspended using hanging devices, such as cordage, chains, or elongate rods. According to one embodiment of the present invention, as illustrated in FIGS. 11 and 12, the first end 28*a* of the connector 28 includes a ring, loop or hook 30 that is structured to be connected to the hanging device 32 that is used to suspend the fixture 14. For example, as illustrated in FIG. 12, a chain 32 extending from the fixture 14 can be secured to the ring 30 of the connector 28 using a quick-link chain member 31, as is well known in the art. In other embodiments (not shown), the first end 28*a* of the connector 28 can define a threaded portion that engages a corresponded threaded aperture defined by the end of the fixture 14 or, alternatively, the first end 28*a* of the connector 28 can be welded or formed integrally with the fixture.

According to one embodiment of the present invention, as illustrated in FIG. 8, the connector 28 includes an elongate threaded portion or stem 34 extending at least partially between the first and second ends 28*a*, 28*b* of the connector. The stem 34 is threaded into a threaded aperture defined by the bottom member 35. Alternatively, the stem 34 can be formed integrally with, or be welded to, the bottom member 35.

The connector 28 also includes an expanded portion or flange 36 disposed generally at the second end 28*b* of the connector. For example, as illustrated in FIG. 8, the expanded portion 36 can include a rectangular nut or fastener defining a threaded aperture therethrough structured to engage the threads defined by the stem 34. Alternatively, the expanded portion 36 can include a nut or other fastener secured to a washer (not shown), which can be threaded unto the stem 34 of the connector 28.

The connector 28 can further include a fastener 38 defining a threaded aperture therethrough structured to engage the threads defined by the elongate threaded portion 34. The fastener 38 is disposed adjacent to the expanded portion 36 and is adjustable relative thereto along the length of the threaded portion 34. As discussed in more detail below, the fastener 38 and expanded portion 36 are used to secure the connector 28 to the bracket 12.

Figure 4:
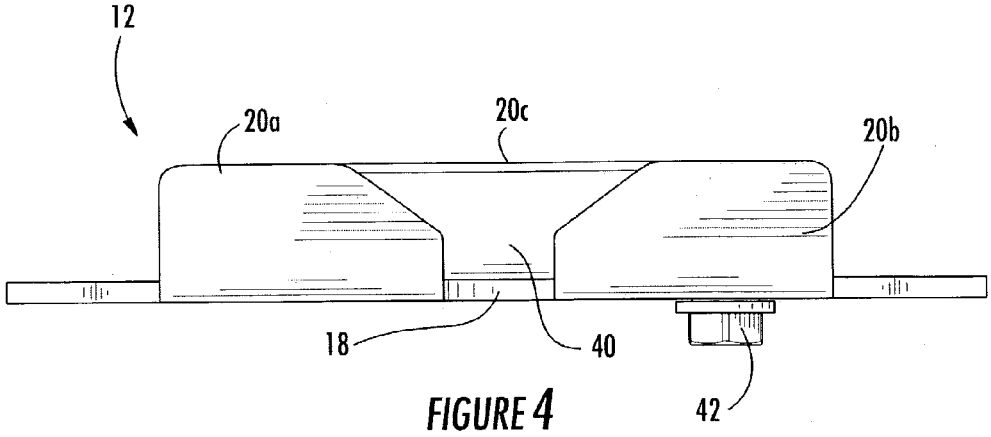
FIG. 4 is an elevation view illustrating the mounting bracket of FIG. 1.
Figure 5:
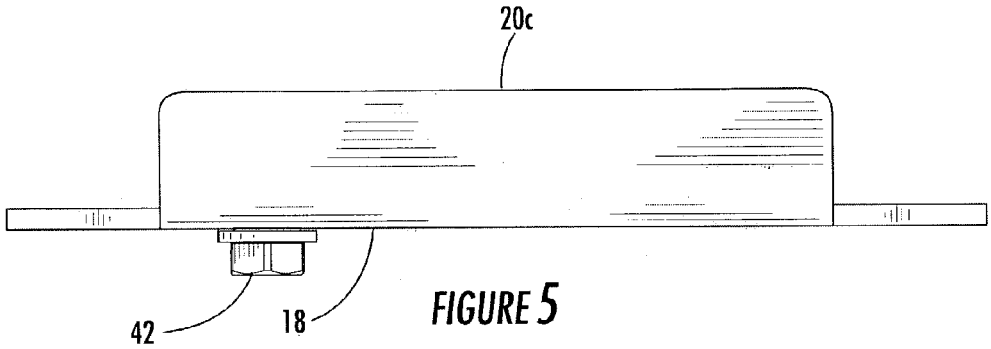
FIG. 5 is an elevation view illustrating the mounting bracket of FIG. 1.
Figure 9:
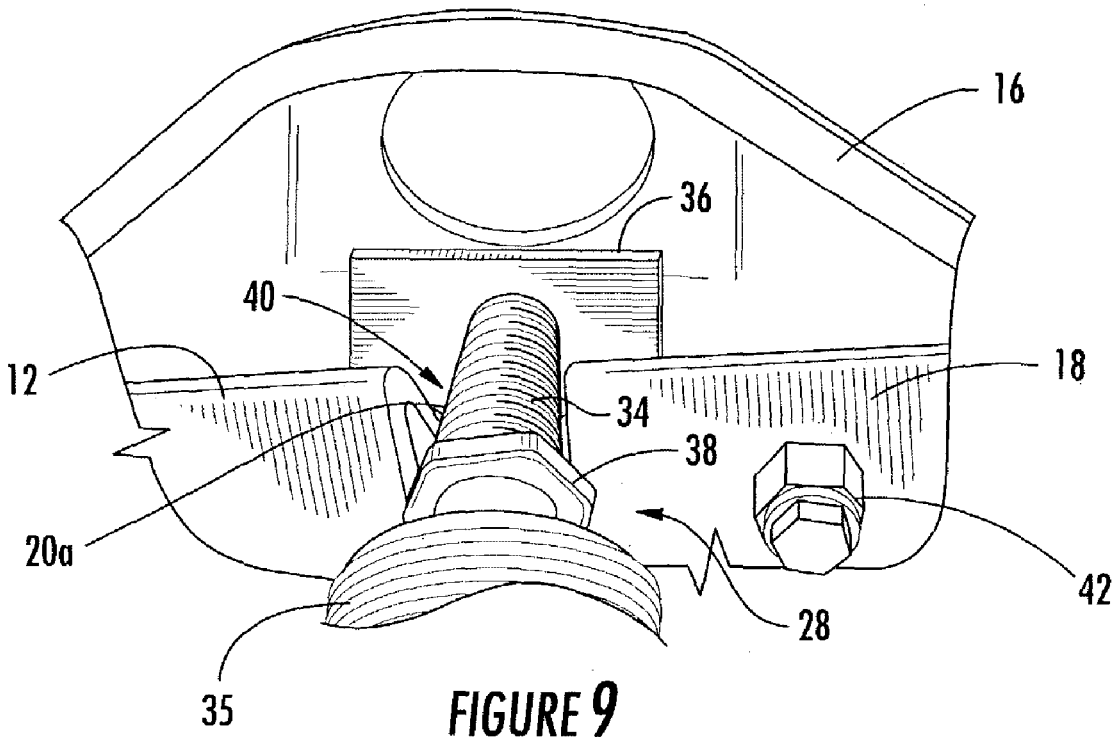
FIG. 9 is a perspective view illustrating the connector of FIG. 7 being mounted onto the mounting bracket of FIG. 1, according to one embodiment of the present invention.
Figure 10:
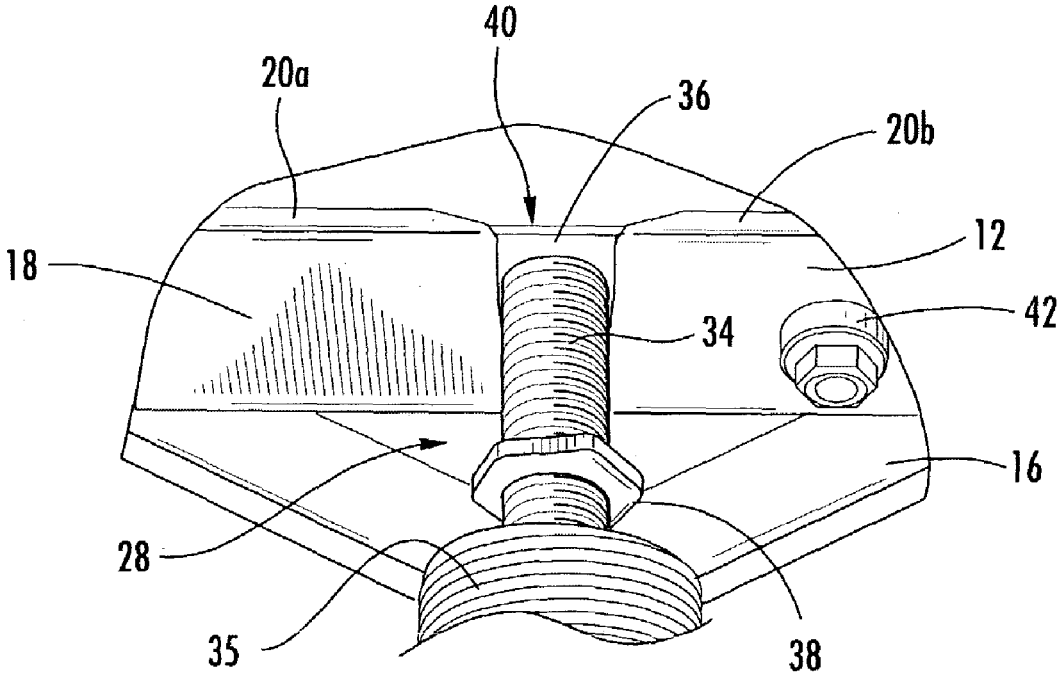
FIG. 10 is a perspective view illustrating the connector and mounting bracket of FIG. 9 with the connector mounted onto the mounting bracket.

As illustrated in FIGS. 1-4, the bracket 12 defines a slot or elongate aperture 40, which extends from the distal edge of the first and second flanges 20*a*, 20*b* to approximately the center of the base 18. The slot 40 is structured to movably or slidably receive an end of the fixture 14, and more specifically, the second end 28*b* of the connector 28 so that the connector does not have to be threadably secured to the bracket 12. Referring to FIG. 8, the stem 34 is attached to the bottom member 35, if necessary, and the expanded portion 36 and the fastener 38 are threaded onto the stem 34. The position of the fastener 38 on the stem 34 is adjusted so that the fastener is adjacent the bottom member 35 to thereby define a gap between the fastener 38 and the expanded portion 36. The height of the gap is approximately equal to or greater than the height of the pair of the first and second flanges 20*a*, 20*b* so that the expanded portion 36 will extend over the edge of the pair of flanges as the stem 34 is slid into and along the length of the slot 40, as illustrated in FIGS. 9 and 10. According to one embodiment, as illustrated in FIG. 4, the corners of the first and second flanges 20*a*, 20*b* can be removed so that the width of the slot 40 gradually increases proximate to the edge of the first and second flanges, which makes it easier to insert the stem 34 into the slot 40.

Once the stem 34 is inserted into the slot 40, the bottom member 35 of the connector 28 is moved away from the bracket 12 so that the expanded portion 36 is brought into contact with the bracket. The width of the expanded portion 36 is greater than the width of the slot 40 so that the stem 34 (and fixture 14) are supported by the bracket 12 through the expanded portion. The fastener 38 can then be tightened against the bracket 12 to secure the stem 34 to the bracket, as illustrated in FIG. 11. Advantageously, the height of the fixture 14 can be easily adjusted by removing the stem 34 from the slot 40, modifying the position of the expanded portion 36 along the length of the stem 34, and then reinserting the stem into the slot, as described above. In addition, the expanded portion 36 preferably is configured so that the expanded portion will restrict rotation of the connector 28 when the connector is mounted to the bracket 12. For example, referring to FIG. 7, if the connector 28 is rotated, the edges of the expanded portion 36, which in the illustrated embodiment is a rectangular fastener, will contact the flanges 20*a*, 20*b*, 20*c* thereby restricting further rotational movement of the connector.

As discussed above, the fixture 14 typically is attached to the bottom member 35 through a hanging device 32, such as cordage, chains, or an elongate rod. Since the installer is not required to support the fixture for a prolonged period, the hanging device 32 (and fixture 14) can be attached to the bottom member 35 when inserting the stem 34 into the slot 40, or the hanging device 32 can be secured to the bottom member 35 after the stem has been inserted into the slot 40 and the bottom member 35 is suspended from the bracket 12. If the fixture is a light fixture, then once the fixture 14 is secured to the bottom member 35 the wiring (not shown) of the light fixture can be connected to the wiring in the electrical junction box 26. According to one embodiment (not shown), the stem 34 is hollow and the bottom member 35 defines an aperture therethrough so that the electrical wiring can be inserted through the stem and bottom member and easily connected to the wiring of the fixture 14. A canopy (not shown) can then be secured in place on the threaded portion of the bottom member 35 using a decorative locking nut (not shown) to cover the bracket 12, wiring, and electrical box 26. If necessary, the bracket 12 also can be provided with a fastener 42 that provides a ground connection for the light fixture 14.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A bracket for attachment to a support for mounting a fixture, comprising:

a base having first and second sides, said base defining an aperture; a fastener corresponding to said aperture, said aperture being configured to receive said corresponding fastener such that said corresponding fastener extends from said base to the support thereby attaching the bracket to the support;

first and second flanges extending from said first side of said base, at least one of said first and second flanges extending from said first side of said base at least partially towards said second side of said base so as to define an acute angle between said base and said at least one of said first and second flanges, said first and second flanges defining an elongate aperture therebetween such that the distal ends of said first and second flanges are unconnected, said elongate aperture further extending into said base from said first side of said base towards said second side of said base; and wherein said elongate aperture is adapted to movably receive one end of the fixture through said elongate aperture and at least partially above said distal ends of said first and second flanges so that the fixture may be mounted to, and demounted from, the bracket by moving the end of the fixture at least partially along the length of said elongate aperture, wherein said first and second flanges and said base adjacent said elongate aperture are configured to retain at least a portion of the end of the fixture so that the fixture is supported by the bracket, and wherein said first and second flanges are structured to contact the support to provide lateral support to the bracket and the fixture.

2. A bracket according to claim 1 wherein said base and said first and second flanges are integrally formed.

3. A bracket according to claim 1 wherein said base and said first and second flanges are formed of steel.

4. A bracket according to claim 1 further comprising a third flange extending from said second side of said base.

5. A bracket according to claim 4 wherein said third flange extends from said second side of said base at least partially towards said first side of said base so as to define an acute angle between said base and said third flange.

6. A bracket for attachment to a support for mounting a fixture, comprising:

a base having first and second sides, said base defining an aperture;

a fastener corresponding to said aperture, said aperture being configured to receive said corresponding fastener such that said corresponding fastener extends from said base to the support thereby attaching the bracket to the support;

first and second flanges extending into said base from said first side of said base at least partially towards said second side of said base so as to define an acute angle between said base and each of said first and second flanges, said first and second flanges defining an elongate aperture therebetween such that the distal ends of said first and second flanges are unconnected, said elongate aperture further extending from said first side of said base towards said second side of said base;

a third flange extending from said second side of said base at least partially towards said first side of said base so as to define an acute angle between said base and said third flange; and wherein said elongate aperture is adapted to movably receive one end of the fixture through said elongate aperture and at least partially above said distal ends of said first and second flanges so that the fixture may be mounted to, and demounted from, the bracket by moving the end of the fixture at least partially along the length of said elongate aperture, wherein said first and second flanges and said base adjacent said elongate aperture are configured to retain at least a portion of the end of the fixture so that the fixture is supported by the bracket, and wherein said first, second, and third flanges are structured to contact the support to provide lateral support to the bracket and the fixture.

7. A bracket according to claim 6 wherein said base and said first, second and third flanges are integrally formed.

8. A bracket according to claim 6 wherein said base and said first, second and third flanges are formed of steel.

9. A mounting system for attaching a fixture to a support, comprising:

a connector having first and second ends, said first end of said connector structured for attachment to the fixture; and a bracket, comprising:

a base having first and second sides, said base defining an aperture;

a fastener corresponding to said aperture, said aperture being configured to receive said corresponding fastener such that said corresponding fastener extends from said base to the support thereby attaching the bracket to the support;

first and second flanges extending from said first side of said base, at least one of said first and second flanges extending from said first side of said base at least partially towards said second side of said base so as to define an acute angle between said base and said at least one of said first and second flanges, said first and second flanges defining an elongate aperture therebetween such that the distal ends of said first and second flanges are unconnected, said elongate aperture further extending into said base from said first side of said base towards said second side of said base; and wherein said elongate aperture is adapted to movably receive said second end of said connector through said elongate aperture and at least partially above said distal ends of said first and second flanges so that the fixture may be mounted to, and demounted from, said bracket by moving said second end of said connector at least partially along the length of said elongate aperture, wherein said first and second flanges and said base adjacent said elongate aperture are configured to retain at least a portion of second end of said connector so that said connector and the fixture are supported by the bracket, and wherein said first and second flanges are structured to contact the support to provide lateral support to the bracket and the fixture.

10. A mounting system according to claim 9 wherein said base and said first and second flanges are integrally formed.

11. A mounting system according to claim 9 wherein said base and said first and second flanges are formed of steel.

12. A mounting system according to claim 9 further comprising a third flange extending from said second side of said base.

13. A mounting system according to claim 12 wherein said third flange extends from said second side of said base at least partially towards said first side of said base so as to define an acute angle between said base and said third flange.

14. A mounting system according to claim 9 wherein said connector comprises:

an elongate threaded portion extending at least partially between said first and second ends of said connector;

an expanded portion disposed at said second end of said connector; and a fastener defining an aperture therethrough structured to threadingly engage said elongate threaded portion, said fastener disposed adjacent to said expanded portion and adjustable relative thereto along the length of said threaded portion.

15. A mounting system for attaching a fixture to a support, comprising:

a connector having first and second ends, said first end of said connector structured for attachment to the fixture; and a bracket, comprising:

a base having first and second sides, said base defining an aperture;

a fastener corresponding to said aperture, said aperture being configured to receive said corresponding fastener such that said corresponding fastener extends from said base to the support thereby attaching the bracket to the support;

first and second flanges extending from said first side of said base at least partially towards said second side of said base so as to define an acute angle between said base and each of said first and second flanges, said first and second flanges defining an elongate aperture therebetween such that the distal ends of said first and second flanges are unconnected, said elongate aperture further extending from said first side of said base towards said second side of said base;

a third flange extending from said second side of said base at least partially towards said first side of said base so as to define an acute angle between said base and said third flange; and wherein said elongate aperture is adapted to movably receive said second end of said connector through said elongate aperture and at least partially above said distal ends of said first and second flanges so that the fixture may be mounted to, and demounted from, said bracket by moving said second end of said connector at least partially along the length of said elongate aperture, wherein said first and second flanges and said base adjacent said elongate aperture are configured to retain at least a portion of second end of said connector so that said connector and the fixture are supported by the bracket, and wherein said first, second, and third flanges are structured to contact the support to provide lateral support to the bracket and fixture.

16. A mounting system according to claim 15 wherein said base and said first, second and third flanges are integrally formed.

17. A mounting system according to claim 15 wherein said base and said first, second and third flanges are formed of steel.

18. A mounting system according to claim 15 wherein said connector comprises:

an elongate threaded portion extending at least partially between said first and second ends;

an expanded portion disposed at said second end; and a fastener defining an aperture therethrough structured to threadingly engage said elongate threaded portion, said fastener disposed adjacent to said expanded portion and adjustable relative thereto along the length of said threaded portion.

19. A method of attaching a fixture to a support, comprising:

providing a bracket, the bracket comprising a base having first and second sides and defining an aperture therethrough, the base having first and second flanges extending from the first side of the base, at least one of the first and second flanges extending from the first side of the base at least partially towards the second side of the base so as to define an acute angle between the base and the at least one of the first and second flanges, the first and second flanges defining an elongate aperture therebetween such that the distal ends of said first and second flanges are unconnected, the elongate aperture further extending into said base from the first side of the base towards the second side of the base, and wherein said first and second flanges are structured to contact the support to provide lateral support to the bracket and fixture;

inserting a fastener through the aperture in the bracket;

securing the fastener to the support to thereby attach the bracket to the support;

inserting at least a portion of one end of the fixture through the elongate aperture and at least partially over the distal ends of the first and second flanges; and positioning at least a portion of the end of the fixture on at least a portion of the base adjacent the elongate aperture, wherein the first and second flanges and the base adjacent the elongate aperture are configured to retain at least a portion of the end of the fixture so that the fixture is supported by the bracket.

20. A method according to claim 19 further comprising connecting electrical wiring from the fixture to the electrical wiring at the support.

21. A method according to claim 19 further comprising moving the end of the fixture at least partially along the length of the elongate aperture and at least partially above said distal ends of said first and second flanges so that the fixture is demounted from the bracket.

22. A method according to claim 19 further comprising threading a fastener along a threaded portion of a connector so that the fastener secures at least a portion of the bracket between the fastener and an expanded portion of the connector to thereby secure the end of the fixture to the bracket.

* * * * *

UNITED STATES PATENT AND TRADEMARK OFFICE

CERTIFICATE OF CORRECTION

PATENT NO. : 7,243,891 B2
APPLICATION NO. : 10/411878
DATED : July 17, 2007
INVENTOR(S) : Wen-Chang Wu, Jeffrey F. Jacumink and Brian J. Severson It is certified that error appears in the above-identified patent and that said Letters Patent is hereby corrected as shown below:

Column 9, line 28, insert --into said base-- after “extending”.

Signed and Sealed this

Twenty-seventh Day of November, 2007

JON W. DUDAS
*Director of the United States Patent and Trademark Office*